US007963414B1

(12) United States Patent
Stravitz

(10) Patent No.: US 7,963,414 B1
(45) Date of Patent: Jun. 21, 2011

(54) WASTE DISPOSAL DEVICE WITH SELF-CLOSING LID

(76) Inventor: David M. Stravitz, New York, NY (US)

( * ) Notice: Subject to any disclaimer, the term of this patent is extended or adjusted under 35 U.S.C. 154(b) by 18 days.

(21) Appl. No.: 12/637,252

(22) Filed: Dec. 14, 2009

Related U.S. Application Data

(60) Provisional application No. 61/138,209, filed on Dec. 17, 2008.

(51) Int. Cl.
*B65D 43/26* (2006.01)

(52) U.S. Cl. ..... 220/264; 220/263; 220/908.1

(58) Field of Classification Search ..... 220/263, 220/264, 908.1
See application file for complete search history.

(56) References Cited

U.S. PATENT DOCUMENTS

| | | | | |
|---|---|---|---|---|
| 2,946,474 | A * | 7/1960 | Knapp | 220/23.87 |
| 4,470,220 | A | 9/1984 | Sudo | |
| 4,576,252 | A | 3/1986 | Omata | |
| 5,125,526 | A | 6/1992 | Sumanis | |
| 5,444,877 | A | 8/1995 | Kumarasurier | |
| 5,794,277 | A | 8/1998 | Jones | |
| 6,024,238 | A | 2/2000 | Jaros | |
| 6,128,890 | A | 10/2000 | Firth | |
| 6,145,283 | A | 11/2000 | Noordenbos | |
| 6,370,847 | B1 | 4/2002 | Jensen et al. | |
| 6,561,055 | B1 | 5/2003 | Turk | |
| 6,612,099 | B2 | 9/2003 | Stravitz | |
| 6,626,316 | B2 | 9/2003 | Yang | |
| 6,719,194 | B2 | 4/2004 | Richards | |
| 6,804,930 | B2 | 10/2004 | Stravitz | |
| 6,851,251 | B2 | 2/2005 | Stravitz | |
| 7,114,314 | B2 | 10/2006 | Stravitz | |
| 7,146,785 | B2 | 12/2006 | Stravitz | |
| 7,316,100 | B2 | 1/2008 | Stravitz et al. | |
| 7,374,060 | B2 * | 5/2008 | Yang et al. | 220/263 |
| 7,434,377 | B2 | 10/2008 | Stravitz et al. | |
| 7,503,152 | B2 | 3/2009 | Stravitz et al. | |
| 7,503,159 | B2 | 3/2009 | Stravitz et al. | |
| 7,617,659 | B2 | 11/2009 | Stravitz et al. | |

* cited by examiner

*Primary Examiner* — Harry A Grosso
(74) *Attorney, Agent, or Firm* — Brian Roffe

(57) ABSTRACT

Waste disposal device adapted to receive a waste-containing member includes a container defining a waste-receiving compartment having an opening, a lid connected to the container and lid having a first, closed position covering the opening of the container and a second, open position in which the opening is exposed, and a rotation mechanism arranged in the container to rotate the waste-containing member when present in the container. The rotation mechanism is arranged to rotate the waste-containing member upon closure of the lid without manual handling of the lid.

24 Claims, 5 Drawing Sheets

WASTE DISPOSAL DEVICE WITH SELF-CLOSING LID

CROSS-REFERENCE TO RELATED APPLICATION

This application claims priority under 35 U.S.C. §119(e) of U.S. provisional patent application Ser. No. 61/138,209 filed Dec. 17, 2008, incorporated by reference herein.

FIELD OF THE INVENTION

The present invention relates generally to waste disposal device into which waste products are placed and more particularly to waste disposal devices having a lid which is opened to enable insertion of waste into an interior of the container and automatically closes to thereby cover the interior of the container.

BACKGROUND OF THE INVENTION

Small waste disposal devices are common in hospitals, doctors' offices and other locations where waste is generated and must be disposed of in a sanitary manner. Further, if the waste emits odors, the waste disposal device should also contain odors emanating from the waste.

Some waste disposal devices include a lid which is coupled to a gear mechanism whereby upon forced manual closure of the lid, the gear mechanism converts the manually-initiated closing movement of the lid into rotation of a twisting mechanism which engages with a length of tubing or a plastic bag in the waste disposal device to thereby cause formation of a twist in the tubing or bag. The twist is situated above the waste products in the tubing or bag so that emanation of odors from the waste products in the container is reduced.

A drawback of such waste disposal devices is that closure of the lid is manually initiated so that the person throwing out the waste product must also come into contact with the lid to urge the lid to close. This contact may be difficult if the person is holding other objects and may also lead to transmission of bacteria from the lid to the person.

It would be desirable to provide a waste disposal device which does not require a person throwing out waste products to manually handle the lid in order to close the lid.

OBJECTS AND SUMMARY OF THE INVENTION

It is an object of the present invention to provide new and improved waste disposal devices including a lid which can be closed without manual initiation or contact and whose closure causes rotation of a waste-containing member in general or more specifically, a twisting mechanism which engages with a length of tubing or a bag in the waste disposal device to thereby form a twist in the tubing or bag.

In order to achieve this object and others, a waste disposal device adapted to receive a waste-containing member in accordance with the invention includes a container defining a waste-receiving compartment having an opening, a lid connected to the container and lid having a first, closed position covering the opening of the container and a second, open position in which the opening is exposed, and a rotation mechanism arranged in the container to rotate the waste-containing member when present in the container. The rotation mechanism is arranged to rotate the waste-containing member upon closure of the lid without manual handling of the lid.

In one embodiment, the rotation mechanism includes at least one rack gear coupled to the lid at an upper end region thereof and a gear assembly having a first gear in meshing engagement with the rack gear(s), and a second, drive gear in meshing engagement with the waste-containing member and which is rotationally coupled to the first gear. The gear assembly may also include at least one additional gear interposed between the first gear and the second gear to transfer rotation of the first gear to the second gear.

The waste disposal device also includes a foot pedal assembly which causes both opening of the lid when depressed and closure of the lid when the pressing force is removed. Specifically, the foot pedal assembly includes a foot pedal which extends outward from a lower region of the container, a horizontal actuating member connected to the foot pedal at a first end region, a rigid vertical actuating member having a slot through which a first projection at the second end of the horizontal actuating member passes and a pivot pin connected to the horizontal actuating member between its ends. An upper end region of the vertical actuating member is coupled to the rack gear(s) and when the rack gear is housed in a frame. The vertical actuating member may be connected to or formed integral with the frame. The foot pedal assembly also includes a spring that extends alongside the vertical actuating member and is connected at its lower end region to a portion of the container, e.g., a base thereof, and at its upper end region to a second projection extending from the vertical actuating member.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
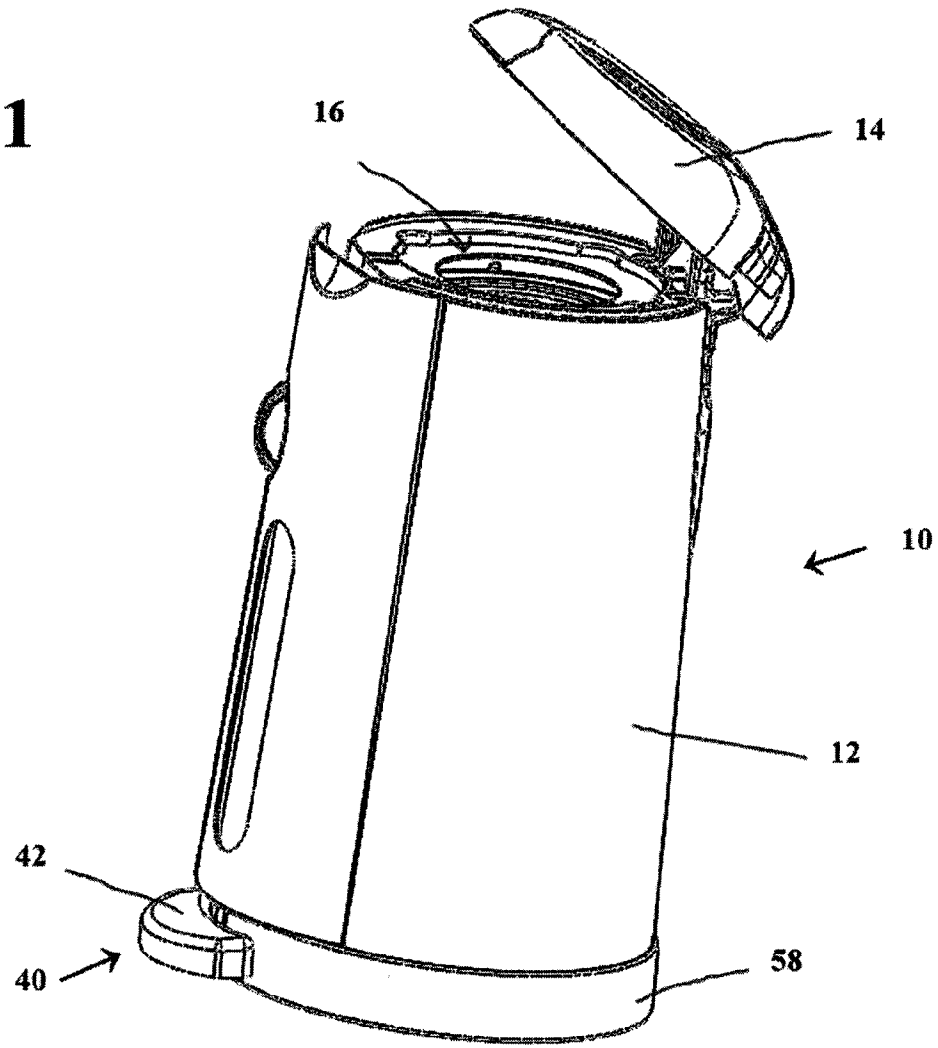
FIG. 1 is a side perspective view of a waste disposal device in accordance with the invention.

Referring to the accompanying drawings wherein like reference numerals refer to the same or similar elements, FIG. 1 shows a waste disposal device in accordance with the invention which is designated generally as 10 and includes a substantially cylindrical container 12 having an outer wall and a base arranged at the lower end region of the outer wall, and which defines a waste-receiving compartment. A lid 14 is pivotally connected to the outer wall so as to be movable between an open position in which a waste insertion opening leading to the waste-receiving compartment is exposed to enable insertion of waste into the container 12 and a closed position in which the lid 14 overlies and closes the waste insertion opening.

A general feature of waste disposal device 10 is that there is rotation of a twisting mechanism 16, only a portion of which is shown in FIG. 1, which engages with tubing or a bag, hereinafter referred to as a waste-containing member, relative to a stationary support or cartridge (not shown) which supports or retains the waste-containing member into which the waste is placed to thereby cause the formation of a twist in the waste-containing member. Rotation of this waste-containing member or the twisting mechanism 16 thereof would occur after insertion of waste to thereby form a twist above the inserted waste and inhibit release of odors from the waste.

To implement this technique, the twisting mechanism 16 is movably seated on a support flange of the container and may have any of several constructions known in the prior art. One such twisting mechanism includes a twisting member having a substantially tubular outer wall, a substantially tubular inner wall, a substantially planar bottom support wall and a circular gear rim adjoining the outer wall and on which projections are formed. The bottom support wall is not contiguous between the outer and inner walls and apertures may be formed therein. The gear rim and its projections may be formed integral or unitary with the twisting member or separate therefrom and then attached thereto.

The twisting mechanism 16 also includes a grasping member such as a membrane arranged to engage with waste-containing member. When the twisting mechanism 16 is rotated, the engagement of the membrane with the waste-containing member causes the waste-containing member to be twisted, i.e., form a twist in the waste-containing member. The engagement of the waste-containing member with the membrane arises since the waste-containing member passes through one or more of the slots between fingers of the membrane. The slots define an aperture through which the waste-containing member passes. Note that the waste-containing member may pass through only one slot, or only partially through one slot, or only partially through two or more slots, or only through the center at the intersection of the slots, and the exact manner depends on the actual use of the waste disposal device.

An aperture, through which the waste-containing member passes, may be formed in the membrane by other means, including, barely discernible small slits extending from a frame supporting the outer edge of the membrane to a center. The membrane may be formed and constructed in different ways and is not limited to the presence of six fingers separated by slots. The material of the fingers may be selected to be flexible so that they flex downward in a direction away from the center when a person pushes waste through the central region of the membrane. The material of the fingers should also be resilient so that the fingers return to their initial form after the person has removed their hand from engagement with the membrane, or the inserted waste has been pushed downward through the membrane and is no longer in engagement therewith. For example, the membrane may be made of silicone or another rubbery material. It may also be made of a flexible synthetic material which flexes under pressure and returns when pressure is removed.

The waste-containing member passing through the slots may tend to flex the fingers downward but the fingers will still remain in engagement with the waste-containing member and enable it to be twisted in the manner described below upon rotation of the membrane. The edges of the fingers which are expected to engage the waste-containing member may be provided with a friction-enhancing material to increase the contact force between the fingers and the waste-containing member.

The membrane may be formed integral with the twisting member or separate therefrom and then attached thereto. For example, the membrane may include an annular channel on its underside which frictionally engages with an annular projection on the twisting member. Friction between the projection on the twisting member and the edges of the channel on the membrane enables the membrane to be securely retained on the twisting member and thus rotated upon and in conjunction with rotation of the twisting member.

Any other structure for fixing the membrane to the twisting member to enable them to rotate together may also be used. Instead of the membrane, another form of a grasping member may be used. The general function of such a grasping member is to engage with the waste-containing member as the waste-containing member passes by it and is capable of twisting the waste-containing member when rotated. For example, the grasping member may be a circular frame having fingers extending inwardly therefrom, or have a comparable structure as disclosed in prior art waste disposal devices.

A rotation mechanism 18 is provided to rotate whatever twisting mechanism 16 is arranged in the container 12, upon closure of the lid 14. Rotation mechanism 18 includes a substantially U-shaped rack gear assembly 20. The U-shaped rack gear assembly 20 includes a substantially U-shaped frame 22 which is pivotally coupled to the lid 14 at the upper ends of the U-shape via one or more pivot pins 24 (see FIG. 3) and a rack gear 26 on the inside surface of one or both of the legs 28 of the U-shaped frame 22 (see FIGS. 3 and 4). Each rack gear 26 has a series of teeth on at least a portion of a longitudinally extending surface.

Instead of a U-shaped rack gear assembly 20 having a U-shaped frame 22, a rack gear assembly having a frame with a different form may be used, or a frame may be entirely omitted. Also, only a single elongate rack gear 26 may be provided. Thus, in a waste disposal device in accordance with the invention, there may be at a minimum, only a single rack gear coupled to the lid 14 and which moves vertically in one direction upon opening of the lid 14 and vertically in the opposite direction upon closing of the lid 14.

Figure 2:
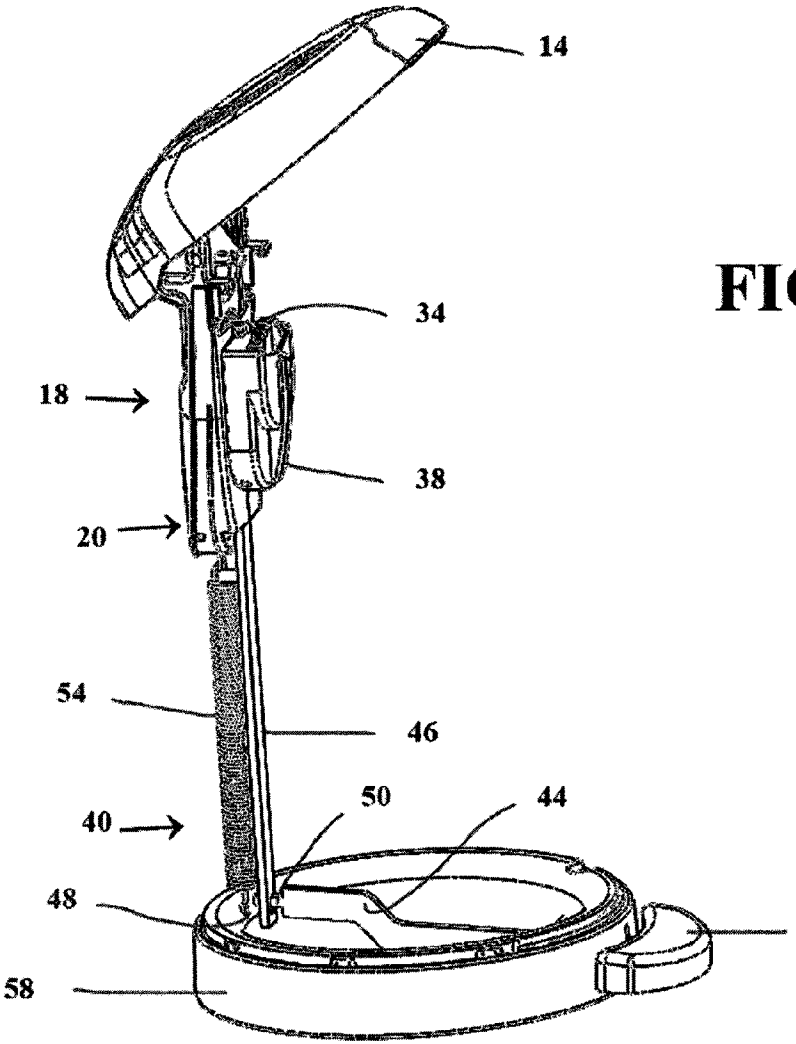
FIGS. 2 and 3 are perspective views of principal parts of the lid movement mechanism in the waste disposal device shown in FIG. 1.

The rotation mechanism 18 also includes a gear assembly 30 having one gear 32 in meshing engagement with the rack gear 26 (see FIG. 3) and one gear 34 in meshing engagement with the projections on the twisting member (this gear being referred to as the drive gear), and then optionally one or more additional gears 36 interposed between the gear 32 in engagement with the rack gear 26 and the drive gear 34. The gear assembly 30, except for a portion of the drive gear 34 which engages with the twisting member, may be situated in a housing 38 (see FIG. 2).

Gear assembly 30 also includes an appropriate mechanism for enabling one-way transmission of rotational force from the rack gear 26 to the drive gear 34. Such mechanisms are known in the prior art. Other gear assemblies including more or less gears than shown can also be used to convert the downward movement of the rack gear 26 into rotational movement of the drive gear 34 in only a single direction. For example, a bevel gear may be used.

In operation, when the lid 14 is closed, the U-shaped frame 22 and thus the rack gear 26 are moved downward causing rotation of the gears 32, 36 in the gear assembly 30 and ultimately rotation of the drive gear 34. The twisting member of the twisting mechanism 16 is thus caused to rotate in view of the engagement between the projections on the gear rim of the twisting member and the drive gear 34. As such, the closing movement of the lid 14 is converted into rotational movement of the twisting member of the twisting mechanism 18.

Other mechanisms for converting the closing movement of the lid 14 into rotational movement of the twisting member of the mechanism 18 are also contemplated within the scope of the invention and include those known in the prior art.

In order to provide for rotation of the twisting member relative to the stationary waste-containing member and thus the formation of a twist in the waste-containing member in the slot(s) between the fingers of the membrane (and which is engaged by the fingers), a mechanism for preventing rotation of the waste-containing member is preferably provided. The anti-rotation mechanism or rotation preventing mechanism may be any of those constructions known in the prior art. For example, if the waste-containing member is tubing housed in a cartridge, then the cartridge could be provided with a plurality of indentations, e.g., four, six, eight, that receive projections on the housing of the container 12.

The waste disposal device 10 also includes a foot pedal assembly 40 which causes both opening of the lid 14 when a foot pedal of the foot pedal assembly 40 is depressed and closure of the lid 14 when the pressing force is removed. The foot pedal assembly 40 may be considered part of the rotation mechanism 18 or not.

Figure 3:
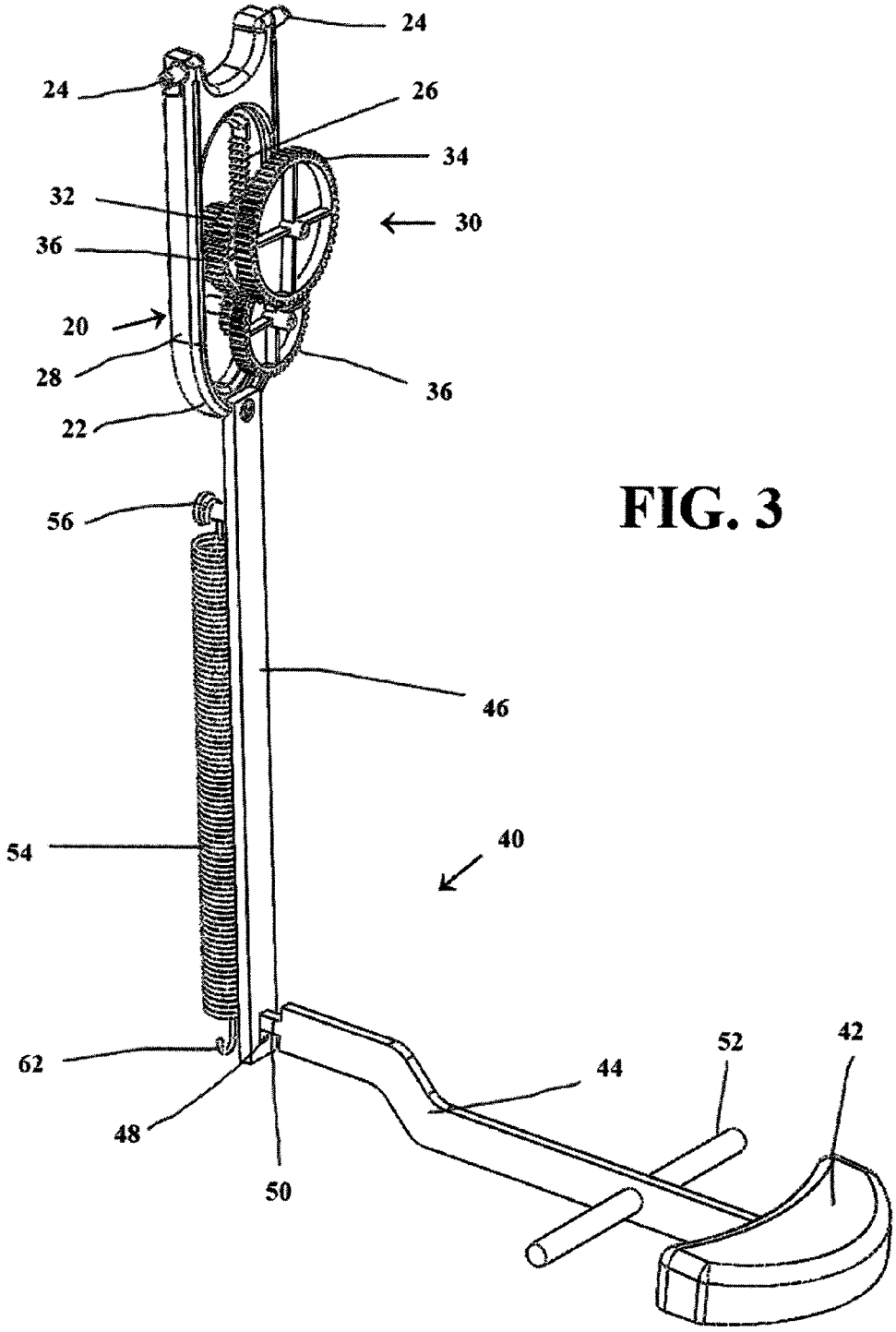
Figure 4:
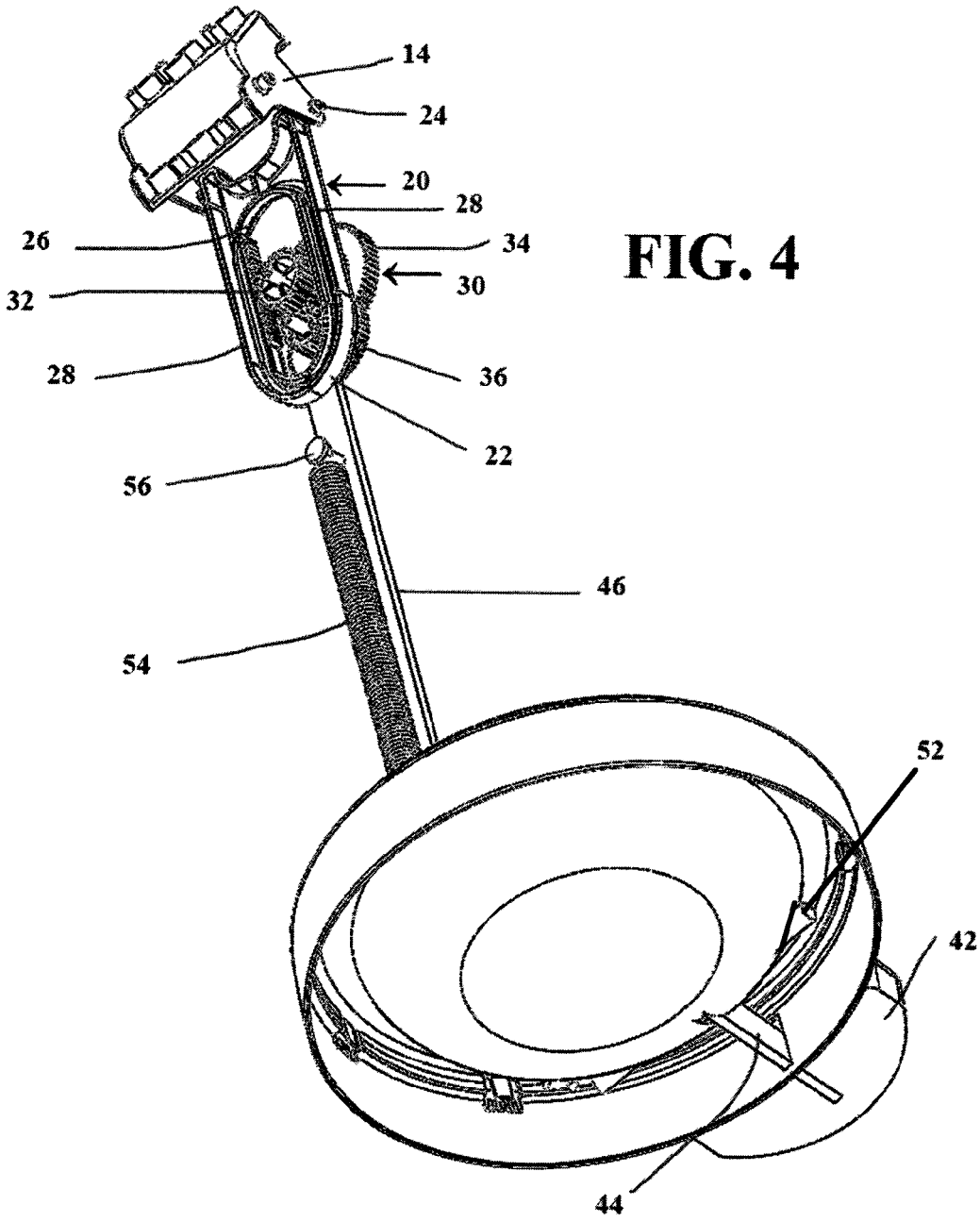
FIG. 4 is a bottom perspective view of principal parts of the lid movement mechanism in the waste disposal device shown in FIG. 1.
Figure 5:
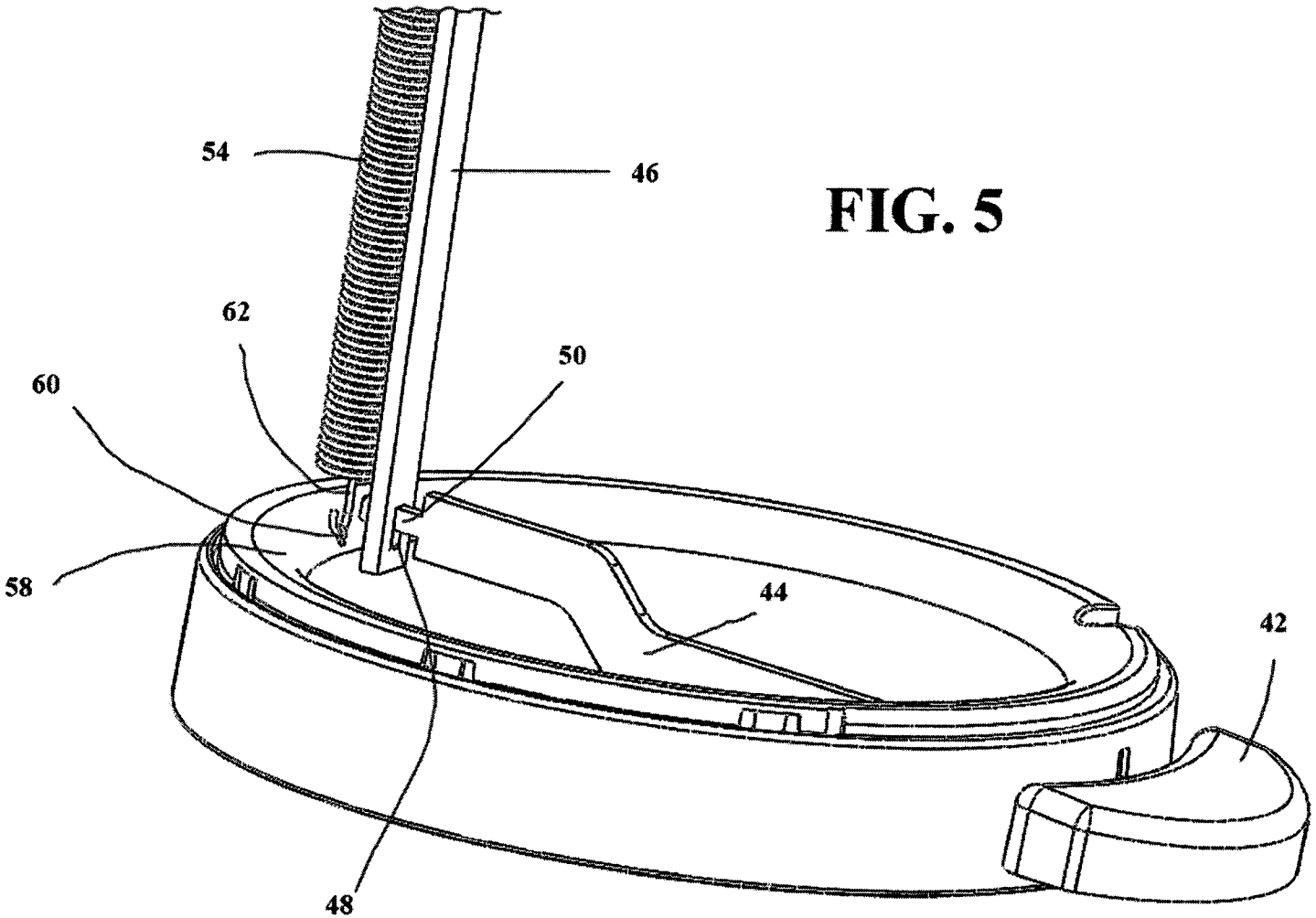
FIG. 5 is an enlarged view of a base region of the waste disposal device shown in FIG. 1 with parts removed to show the lid movement mechanism.

The foot pedal assembly 40 includes the foot pedal 42 which extends outward from a lower region of the container 12, a horizontal actuating member 44 connected to the foot pedal 42 at a first end region, a rigid vertical actuating member 46 having a slot 48 through which a projection 50 at the second end region of the horizontal actuating member 44 passes and a pivot pin 52 connected to the horizontal actuating member 44 between its ends (see FIGS. 3 and 4). An upper end region of the vertical actuating member 46 is connected to the U-shaped frame 22, or formed integral therewith (see FIG. 3). The pivot pin 52 is retained as its ends extend through apertures in a base of the container 12 (see FIG. 4).

The foot pedal assembly 40 also includes a spring 54 that extends alongside the vertical actuating member 46 and is connected at its upper end to a projection 56 extending from the vertical actuating member 46 (see FIGS. 2-5) and at its lower end region to a loop 60 extending from a base portion 58 of the container 12 (see FIG. 4). The spring 54 may include a hook 62 at its upper end which is hooked onto or over the projection 56. The spring 54 may additionally or alternatively include a hook at its lower end which is hooked onto or through the loop 60. Instead of projection 56 and loop 60, apertures may be formed, i.e., in a portion of the vertical actuating member 46 and the base portion 58, in which the hooks of the spring 54 could be retained.

With this structure, depression of the foot pedal 42 causes pivoting of the horizontal actuating member 44 about the pivot pin 52, i.e., the first end of the horizontal actuating member 44 proximate the foot pedal 42 pivots downward while the second end of the horizontal actuating member 44 proximate the vertical actuating member 46 pivots upward. This upward pivotal movement causes the projection 50 to abut against the upper interior surface defining the slot 48 and urge the vertical actuating member 46 upward. At the same time, the spring 54 is tensioned in view of the fixing of its lower end to the base portion 58 and the fixing of its upper end to the projection 56 on the vertical actuating member 46. The upward movement of the vertical actuating member 42 causes the U-shaped frame 20 to move upward thereby forcing the lid 14 to open. In view of the presence of the optional mechanism to enable one-way transmission of rotational force from the rack gear 26 to the drive gear 34, the drive gear 34 is not rotated during the opening movement of the lid 14.

As long as the foot pedal 42 is depressed, i.e., by the user's foot, the lid 14 will remain open. However, once the force depressing the foot pedal 42 is removed, the spring 54 will naturally compress and urge the vertical actuating member 46 downward, in turn causing the U-shaped frame 22 to be urged downward thereby causing the rack gear 26 to move downward. As described above, the downward movement of the rack gear 26 is converted into rotation of the drive gear 34 and thus rotation of the twisting member of the twisting mechanism 16. At the same time, the first end of the horizontal actuating member 44 proximate the foot pedal 42 will also be pivoted upward into a position in which it can be depressed again.

Thus, the foot pedal assembly 40 enables use of the waste disposal device 10, both opening of the lid 14 and closing of the lid 14, solely by use of the user's foot (in a hands-free manner). Therefore, there is no manual contact between the user's hands and any portion of the waste disposal device 10 which is required in order to open the lid 14 or close the lid 14. This eliminates any problems resulting from the user holding other materials and being unable to close the lid as well as problems resulting from contact between the user's hands and bacteria or other harmful microorganisms on the lid.

Waste disposal device 10 may be used for any type of waste, including but not limited to medical waste from hospitals, doctors' offices, home health care personnel and facilities, nursing homes, biohazard laboratories, and the like. The waste disposal device 10 may also be used for personal hygiene such as for disposing of soiled diapers.

Modifications to the waste disposal device 10 are envisioned. For example, an access door may be formed in the outer wall of the container 12 to pivot about hinges to enable access to an interior waste-receiving chamber of the container 12 in which a pail may be placed to receive a bag which will be filled with waste during use of the waste disposal device 10. A closure mechanism would be provided to secure the door in a closed position.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, although the rotation mechanism 18 is described above to rotate a twisting mechanism relative to a stationary support or cartridge which supports or retains a waste-containing member, it is conceivable that the same rotation mechanism can be arranged to rotate a support or cartridge which supports or retains a waste-containing member relative to a stationary twisting mechanism.

The invention claimed is:

1. In a waste disposal device adapted to receive a waste-containing member, comprising:

a container defining a waste-receiving compartment having an opening;

a lid connected to said container, said lid having a first, closed position covering said opening of said container and a second, open position in which said opening is exposed;

a rotation mechanism arranged in said container to rotate the waste-containing member when present in said container, said rotation mechanism being arranged to rotate the waste-containing member only upon closure of said lid without manual handling of said lid and not upon opening of said lid, said rotation mechanism comprising at least one elongate member coupled to said lid and arranged such that downward movement of said at least one elongate member causes rotation of said waste-containing member; and the improvement comprising:

a foot pedal assembly comprising a depressible foot pedal and a spring, said foot pedal assembly being arranged to cause both opening of said lid when said foot pedal is depressed and closure of said lid when the pressing force is removed, said spring being arranged to be tensioned upon depression of said foot pedal and compress when the pressing force is removed, said spring being coupled to said at least one elongate member such that when said spring compresses, said spring pulls said at least one elongate member downward and thereby causes closure of said lid coupled to said at least one elongate member and rotation of said waste-containing member.

2. The device of claim 1, wherein said at least one elongate member comprises at least one rack gear.

3. The device of claim 2, wherein said rotation mechanism further comprises a gear assembly having a first gear in meshing engagement with said at least one rack gear, and a second, drive gear in meshing engagement with the waste-containing member and which is rotationally coupled to said first gear.

4. The device of claim 3, wherein said gear assembly further comprises at least one additional gear interposed between said first gear and said second gear to transfer rotation of said first gear to said second gear.

5. The device of claim 2, wherein said rotation mechanism further includes a U-shaped frame pivotally coupled to said lid at an upper end region thereof, said at least one rack gear being arranged on an inside surface of a respective leg of said U-shaped frame.

6. The device of claim 3, wherein said spring is arranged to cause the meshing engagement of said first gear with said at least one rack gear during compression of said spring.

7. The device of claim 1, wherein said foot pedal assembly further includes a horizontal actuating member connected to said foot pedal at a first end region, a vertical actuating member having a slot through which a projection at the second end of said horizontal actuating member passes and a pivot pin connected to said horizontal actuating member between its ends.

8. The device of claim 7, wherein said spring extends alongside said vertical actuating member and is connected at its lower end region to said container and at its upper end region to said vertical actuating member.

9. The device of claim 7, wherein said rotation mechanism comprises at least one rack gear coupled to said lid and said vertical actuating member is coupled to said at least one rack gear.

10. The device of claim 1, wherein said rotation mechanism further comprises a force transmission mechanism having a first member engaging with said at least one elongate member coupled to said lid and a second member engaging with the waste-containing member and which is motively coupled to said first member.

11. The device of claim 10, wherein said at least one elongate member is a rack gear, said first and second members are gears rotationally coupled together.

12. The device of claim 1, wherein said foot pedal assembly further comprises a horizontal actuating member connected to said foot pedal and pivotable about a middle region thereof, and a vertical actuating member having a slot through which part of said horizontal actuating member passes.

13. The device of claim 12, wherein said horizontal actuating member is connected to said foot pedal at a first end region, said horizontal actuating member having an end projection passing through said slot of said vertical actuating member, said foot pedal assembly further comprising a pivot pin connected to said horizontal actuating member between its ends.

14. The device of claim 12, wherein said spring extends alongside said vertical actuating member and is connected at its lower end region to said container and at its upper end region to said vertical actuating member.

15. The device of claim 12, wherein said at least one elongate member comprises at least one rack gear and said vertical actuating member is coupled to said at least one rack gear.

16. In a waste disposal device, comprising:

a container defining a waste-receiving compartment having an opening;

a lid connected to said container, said lid having a first, closed position covering said opening of said container and a second, open position in which said opening is exposed;

a support that supports a waste-containing member and enables rotation of the waste-containing member;

a rotation mechanism arranged in said container to rotate the waste-containing member when present in said container, said rotation mechanism being arranged to rotate the waste-containing member only upon closure of said lid without manual handling of said lid and not upon opening of said lid, said rotation mechanism comprising at least one elongate member coupled to said lid and arranged such that downward movement of said at least one elongate member causes rotation of said waste-containing member; and the improvement comprising:

a foot pedal assembly comprising a depressible foot pedal and a spring, said foot pedal assembly being arranged to cause both opening of said lid when said foot pedal is depressed and closure of said lid when the pressing force is removed, said spring being arranged to be tensioned upon depression of said foot pedal and compress when the pressing force is removed, said spring being coupled to said at least one elongate member such that when said spring compresses, said spring pulls said at least one elongate member downward and thereby causes closure of said lid coupled to said at least one elongate member and rotation of said waste-containing member.

17. The device of claim 16, wherein said foot pedal assembly further includes a horizontal actuating member connected to said foot pedal and pivotable about a middle region thereof, and a vertical actuating member having a slot through which part of said horizontal actuating member passes.

18. The device of claim 17, wherein said horizontal actuating member is connected to said foot pedal at a first end region, said horizontal actuating member having an end projection passing through said slot of said vertical actuating member, said foot pedal assembly further comprising a pivot pin connected to said horizontal actuating member between its ends.

19. The device of claim 17, wherein said spring extends alongside said vertical actuating member and is connected at its lower end region to said container and at its upper end region to said vertical actuating member.

20. The device of claim 17, wherein said at least one elongate member comprises at least one rack gear coupled to said lid and said vertical actuating member is coupled to said at least one rack gear.

21. In a waste disposal device adapted to receive a waste-containing member, comprising:

a container defining a waste-receiving compartment having an opening;

a lid connected to said container, said lid having a first, closed position covering said opening of said container and a second, open position in which said opening is exposed; and a rotation mechanism arranged in said container to rotate the waste-containing member when present in said container, said rotation mechanism being arranged to rotate the waste-containing member upon closure of said lid without manual handling of said lid, the improvement comprising:

said rotation mechanism comprising:

at least one rack gear coupled to said lid; and a U-shaped frame pivotally coupled to said lid at an upper end region thereof, said at least one rack gear being arranged on an inside surface of a respective leg of said U-shaped frame.

22. In a waste disposal device adapted to receive a waste-containing member, comprising:

a container defining a waste-receiving compartment having an opening;

a lid connected to said container, said lid having a first, closed position covering said opening of said container and a second, open position in which said opening is exposed; and a rotation mechanism arranged in said container to rotate the waste-containing member when present in said container, said rotation mechanism being arranged to rotate the waste-containing member upon closure of said lid without manual handling of said lid;

the improvement comprising:

a foot pedal assembly which causes both opening of said lid when depressed and closure of said lid when the pressing force is removed, said foot pedal assembly including a foot pedal, a horizontal actuating member connected to said foot pedal at a first end region, a vertical actuating member having a slot through which a projection at the second end of said horizontal actuating member passes and a pivot pin connected to said horizontal actuating member between its ends, said rotation mechanism comprising at least one rack gear coupled to said lid, said vertical actuating member being coupled to said at least one rack gear.

23. In a waste disposal device adapted to receive a waste-containing member, comprising:

a container defining a waste-receiving compartment having an opening;

a lid connected to said container, said lid having a first, closed position covering said opening of said container and a second, open position in which said opening is exposed; and a rotation mechanism arranged in said container to rotate the waste-containing member when present in said container, said rotation mechanism being arranged to rotate the waste-containing member upon closure of said lid without manual handling of said lid;

the improvement comprising:

a foot pedal assembly which causes both opening of said lid when depressed and closure of said lid when the pressing force is removed, said foot pedal assembly including a foot pedal, a horizontal actuating member connected to said foot pedal and pivotable about a middle region thereof, and a vertical actuating member having a slot through which part of said horizontal actuating member passes;

said rotation mechanism comprising at least one rack gear coupled to said lid, said vertical actuating member being coupled to said at least one rack gear.

24. In a waste disposal device, comprising:

a container defining a waste-receiving compartment having an opening;

a lid connected to said container, said lid having a first, closed position covering said opening of said container and a second, open position in which said opening is exposed;

a support that supports a waste-containing member and enables rotation of the waste-containing member; and a rotation mechanism arranged in said container to rotate the waste-containing member when present in said container, said rotation mechanism being arranged to rotate the waste-containing member upon closure of said lid without manual handling of said lid;

the improvement comprising:

a foot pedal assembly which causes both opening of said lid when depressed and closure of said lid when the pressing force is removed, said foot pedal assembly including a foot pedal, a horizontal actuating member connected to said foot pedal and pivotable about a middle region thereof, and a vertical actuating member having a slot through which part of said horizontal actuating member passes, said rotation mechanism comprising at least one rack gear coupled to said lid, said vertical actuating member being coupled to said at least one rack gear.

* * * * *